US009635733B2

(12) United States Patent
Shea et al.

(10) Patent No.: US 9,635,733 B2
(45) Date of Patent: Apr. 25, 2017

(54) AUTOMATIC LIGHT FIXTURE ADDRESS SYSTEM AND METHOD

(71) Applicant: Lumenpulse Lighting Inc., Montreal (CA)

(72) Inventors: Casey Shea, Cambridge, MA (US); Gregory Campbell, Walpole, MA (US)

(73) Assignee: Lumenpulse Lighting, Inc. (CA)

( * ) Notice: Subject to any disclaimer, the term of this patent is extended or adjusted under 35 U.S.C. 154(b) by 248 days.

(21) Appl. No.: 13/860,054

(22) Filed: Apr. 10, 2013

(65) Prior Publication Data

US 2013/0293157 A1 Nov. 7, 2013

Related U.S. Application Data

(60) Provisional application No. 61/642,758, filed on May 4, 2012.

(51) Int. Cl.

| | |
|---|---|
| ***H05B 37/00*** | (2006.01) |
| ***H05B 39/00*** | (2006.01) |
| ***H05B 41/00*** | (2006.01) |
| ***H05B 37/02*** | (2006.01) |

(52) U.S. Cl.
CPC ..... *H05B 37/02* (2013.01); *H05B 37/0254* (2013.01)

(58) Field of Classification Search
CPC ..... H05B 37/02
USPC ..... 315/312
See application file for complete search history.

(56) References Cited

U.S. PATENT DOCUMENTS

| | | | | |
|---|---|---|---|---|
| 5,751,118 | A | 5/1998 | Mortimer | |
| 6,292,901 | B1 | 9/2001 | Lys et al. | |
| 6,331,756 | B1 | 12/2001 | Belliveau | |
| 6,969,954 | B2 | 11/2005 | Lys | |
| 7,550,931 | B2 | 6/2009 | Lys et al. | |
| 7,777,427 | B2 | 8/2010 | Stalker, III | |
| 7,961,113 | B2 | 6/2011 | Rabiner et al. | |
| 8,319,452 | B1 | 11/2012 | Hamel et al. | |
| 2004/0160199 | A1 | 8/2004 | Morgan et al. | |
| 2005/0275626 | A1 | 12/2005 | Mueller et al. | |
| 2006/0077192 | A1 | 4/2006 | Thielemans et al. | |
| 2007/0273290 | A1 | 11/2007 | Ashdown et al. | |
| 2009/0051506 | A1* | 2/2009 | Hicksted | B60Q 1/2611 340/332 |
| 2009/0066266 | A1 | 3/2009 | Jungwirth et al. | |
| 2009/0096993 | A1 | 4/2009 | Valazquez | |
| 2009/0153352 | A1 | 6/2009 | Julio | |
| 2009/0160627 | A1 | 6/2009 | Godbole | |
| 2009/0267875 | A1 | 10/2009 | Guo et al. | |
| 2011/0103401 | A1 | 5/2011 | Welten | |

(Continued)

*Primary Examiner* — Lincoln Donovan
*Assistant Examiner* — Metasebia Retebo
(74) *Attorney, Agent, or Firm* — Burns & Levinson LLP; Joseph M. Maraia

(57) ABSTRACT

In some examples, automatic light fixture address technology includes methods and apparatuses. In other examples, the method includes receiving a disable forward control command to disable data forwarding through the light fixture; receiving an enable forward control command to enable data forwarding through the light fixture; transmitting address data for the light fixture based on the enable forward control command; and forwarding one or more additional enable forward control commands based on the enable forward control command.

23 Claims, 4 Drawing Sheets

(56) References Cited

U.S. PATENT DOCUMENTS

| | | | | |
|---|---|---|---|---|
| 2011/0140611 | A1 | 6/2011 | Elek et al. | |
| 2011/0148836 | A1 | 6/2011 | Rumreich | |
| 2011/0178650 | A1 | 7/2011 | Picco | |
| 2012/0038275 | A1 | 2/2012 | Pohler et al. | |
| 2012/0098445 | A1* | 4/2012 | Park ..... | H05B 37/0272 315/193 |
| 2012/0098446 | A1 | 4/2012 | Kim et al. | |

* cited by examiner

AUTOMATIC LIGHT FIXTURE ADDRESS SYSTEM AND METHOD

RELATED APPLICATIONS

The present application claims priority to U.S. Provisional Patent Application No. 61/642,758, filed May 4, 2012, the entire contents of which is incorporated in its entirety herein by reference.

BACKGROUND

A recurring problem with architectural lighting arrays is the planning, installation, management and/or control of the array of the lighting elements, particularly given the variety of types and configurations of LED lighting units currently available. It will be appreciated that these problems increase significantly with the size and complexity of the lighting arrays and with such factors as the dynamic control of the architectural lighting displays to provide lighting effects that vary with time. Thus, a need exists in the art for improved automatic light fixture addressing processes and apparatuses for a light system with the features as described herein.

SUMMARY

One approach to a light controller is a system. The system includes a plurality of light fixtures in serial communication with each other, each light fixture of the plurality of light fixtures being individually controllable via the serial communication based on commands received by a master light fixture in the plurality of light fixtures, wherein each light fixture of the plurality of light fixtures comprising: a processor configured to instruct a transmitter to disable transmission of control commands based on a disable forward control command and enable transmission of control commands based on an enable forward control command; and a light array controller configured to transmit the disable forward control command and the enable forward control command to the master light fixture in the plurality of light fixtures.

Another approach to a light controller is a method for automatic light fixture addressing. The method includes receiving, via a processor in a light fixture, a disable forward control command to disable data forwarding through the light fixture; receiving, via the processor in the light fixture, an enable forward control command to enable data forwarding through the light fixture; transmitting, via the processor in the light fixture, address data for the light fixture based on the enable forward control command; and forwarding, via the processor in the light fixture, one or more additional enable forward control commands based on the enable forward control command.

Another approach to a light controller is a method for automatic light fixture addressing. The method includes step (a) transmitting, via a processor in a light array controller, a disable forward control command to a master light fixture serially connected to a plurality of light fixtures, the plurality of light fixtures are serially connected to each other; step (b) transmitting, via the processor in the light array controller, an enable forward control command to the master light fixture; step (c) receiving, via the processor in the light array controller, address data for the master light fixture or one of the plurality of light fixtures; step (d) repeating the transmitting step (b) and the receiving step (c) based on a device parameter.

Any of the approaches described herein can include one or more of the following examples.

In some examples, each processor is further configured to transmit address data for the respective light fixture based on the enable forward control command.

In other examples, each processor is further configured to forward one or more additional enable forward control commands based on the enable forward control command.

In some examples, the light array controller is further configured to receive address data for each of the plurality of light fixtures in response to the enable forward control command.

In other examples, the light array controller is further configured to associate the received address data with each of the plurality of light fixtures.

In some examples, the light array controller is further configured to transmit a light command to an individual light fixture in the plurality of light fixtures based on the address data associated with the individual light fixture.

In other examples, the disable forward control command and the enable forward command are in a remote device management (RDM) lighting protocol.

In some examples, the one or more light fixtures include a plurality of light emitting diodes (LEDs).

In other examples, the method further includes (a-1) receiving, via a second processor in a second light fixture, a second disable forward control command to disable data forwarding through the second light fixture; (b-1) receiving, via the second processor in the second light fixture, a second enable forward control command to enable data forwarding through the second light fixture; (c-1) transmitting, via the second processor in the second light fixture, second address data for the second light fixture based on the second enable forward control command; and (d-1) forwarding, via the second processor in the second light fixture, one or more additional enable forward control commands based on the second enable forward control command, wherein the light fixture and the second light fixture are serially connected.

In some examples, the disable forward control command and the enable forward command are in a remote device management (RDM) lighting protocol.

In other examples, the method further includes the repeating step (d) further comprising (d-1) determining the device parameter based on a time period from the transmitting step (b) and a time-out parameter.

In some examples, the method further includes the repeating step (d) further comprising (d-2) determining the time-out parameter based a number of the plurality of light fixtures.

In other examples, the method further includes (a-1) receiving the device parameter from an operator associated with the light array controller, the device parameter is a number of the plurality of light fixtures.

In some examples, the method further includes (e) transmitting a light command to a light fixture in the plurality of light fixtures based on the received address data for the light fixture.

In other examples, the method further includes (e) associating the received address data from the plurality of light fixtures with individual light fixtures within the plurality of light fixtures.

Another approach is a light array controller that includes one or more processors and memory. The memory includes code representing instructions that when executed cause the one or more processors to (a) transmit a disable forward control command to a master light fixture serially connected to a plurality of light fixtures, the plurality of light fixtures are serially connected to each other, and (b) transmit an enable forward control command to the master light fixture.

In some embodiments, the memory includes code representing instructions that when executed cause the one or more processors to (c) receive address data for the master light fixture or one of the plurality of light fixtures. In some embodiments, the memory includes code representing instructions that when executed cause the one or more processors to (d) repeat the transmitting step (b) and the receiving step (c) based on a device parameter.

In some embodiments, the memory includes code representing instructions that when executed cause the one or more processors to repeat step (d) and further including (d-1) determining the device parameter based on a time period from the transmitting step (b) and a time-out parameter. In some embodiments, the memory includes code representing instructions that when executed cause the one or more processors to repeat step (d) and further including (d-2) determining the time-out parameter based a number of the plurality of light fixtures.

In some embodiments, the memory includes code representing instructions that when executed cause the one or more processors to (a-1) receive the device parameter from an operator associated with the light array controller, the device parameter is a number of the plurality of light fixtures. In some embodiments, the memory includes code representing instructions that when executed cause the one or more processors to (e) transmit a light command to a light fixture in the plurality of light fixtures based on the received address data for the light fixture. In some embodiments, the memory includes code representing instructions that when executed cause the one or more processors to (e) associate the received address data from the plurality of light fixtures with individual light fixtures within the plurality of light fixtures.

The power line light controller systems and methods described herein (hereinafter "technology") can provide one or more of the following advantages. An advantage of the technology is an array of light fixtures can be automatically provisioned during installation which decreases installation cost by reducing the manual labor time required to determine the addresses for each of the light fixtures in the array of light fixtures. Another advantage of the technology is that the automatic addressing decreases mis-labeling of light fixtures during the installation process since the process is automated, thereby reducing maintenance costs associated with fixing mislabeled light fixtures during operation. Another advantage of the technology is that the automatic addressing decreases the installation time for a light array installation, thereby increasing efficiency and decreasing costs.

BRIEF DESCRIPTION OF THE DRAWINGS

The foregoing and other objects, features and advantages will be apparent from the following more particular description of the embodiments, as illustrated in the accompanying drawings in which like reference characters refer to the same parts throughout the different views. The drawings are not necessarily to scale, emphasis instead being placed upon illustrating the principles of the embodiments.

DETAILED DESCRIPTION

As a general overview of automatic light fixture addressing processes and apparatuses for a light emitting diode (LED) light system (hereinafter referred to as "technology"), the technology includes a step by step enablement process for a series of light fixtures to automatically address the light fixture. The technology advantageously enables the automatic addressing of serially connected light fixtures which reduces installation cost (e.g., manually configuration during provisioning) and maintenance cost (e.g., manually configuration after light replacement). The technology utilizes enable and disable commands to sequentially turn on communication forwarding for serially connected light fixtures (e.g., global disable command then sequentially enable commands for each light fixture). As each light fixture sequentially turns on forwarding, the light fixture returns address data to a light controller. The light controller can collect the address data and associate the address data with the light fixture. The light controller can control each of the light fixtures using the address data (e.g., turn on command to light fixture using address ABC, change intensity command to light fixture using address GHL).

Figure 1:
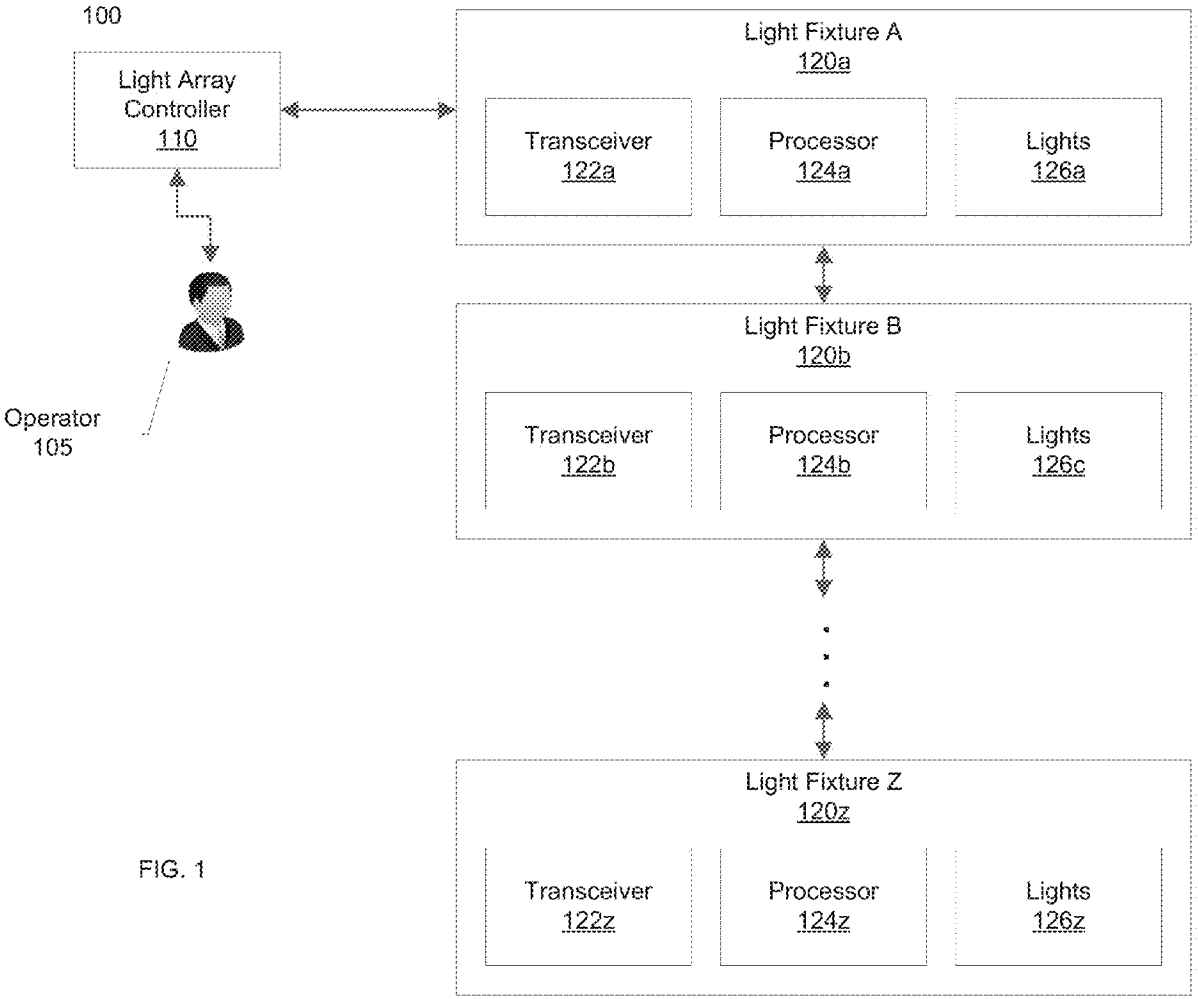
FIG. 1 is a block diagram of an exemplary lighting environment.

FIG. 1 is a block diagram of an exemplary lighting environment 100. The environment 100 includes a light array controller 110 and a plurality of light fixtures A 120*a*, B 120*b* through Z 120*z*. The plurality of light fixtures A 120*a*, B 120*b* through Z 120*z* are in serial communication with each other. Each light fixture of the plurality of light fixtures A 120*a*, B 120*b* through Z 120*z* is individually controllable via the serial communication based on commands received by a master light fixture (in this example, the light fixture A 120*a*) in the plurality of light fixtures. In other words, the light fixtures forward commands to the appropriate light fixture based on address data associated with the commands (e.g., turn on command includes address ABD, change color temperature associated with address GGG).

The light array controller 110 transmits a disable forward control command and one or more enable forward control commands to the master light fixture A 120*a*. The master light fixture A 120*a* receives the commands and can process and/or forward each command. For example, if the master light fixture A 120*a* receives a disable forward control command, the master light fixture A 120*a* transmits the disable forward control command to the next light fixture in the chain (e.g., directly connected to the master light fixture A 120*a*) and disables command forwarding.

Each light fixture A 120*a*, B 120*b* through Z 120*z* includes a transceiver 122*a*, 122*b* through 122*z*, a processor 124*a*, 124*b* through 124*z*, and lights 126*a*, 126*b* through 126*z*. Each processor 124*a*, 124*b* through 124*z* instructs the transceiver 122*a*, 122*b* through 122*z*, respectively, (e.g., a transmitter, a receiver) to disable transmission of control commands based on the disable forward control command and enable transmission of control commands based on the enable forward control command. Each processor 124*a*, 124*b* through 124*z* can control the respective lights 126*a*, 126*b* through 126*z* based on one or more control commands (e.g., turn on, turn off, change the intensity). In some examples, each processor 124*a*, 124*b* through 124*z* executes the operating system and/or any other computer executable instructions for the respective light fixture (e.g., executes applications).

Table 1 illustrates the status for the light fixtures. As illustrated in Table 1, the enable forward control command cascades through the plurality of light fixtures to sequentially turn on forwarding for each light fixture. In this example, the light fixtures are connected serially, Light Fixture A 120*a* to Light Fixture B 120*b* to Light Fixture C to Light Fixture D to Light Fixture E, and the sequential transmission of the enable forward control command enables the technology to advantageously automatically address the slave devices in the serial chain, which decreases the installation time and cost.

TABLE 1

| Status of Light Fixtures | | | | | | |
|---|---|---|---|---|---|---|
| | Commands from Light Array Controller 110 | | | | | |
| | Disable Forward Control Command | Enable Forward Control Command | Enable Forward Control Command | Enable Forward Control Command | Enable Forward Control Command | Enable Forward Control Command |
| Light Fixture A 120a | Forward Disabled | Forward Enabled | Forward Enabled | Forward Enabled | Forward Enabled | Forward Enabled |
| Light Fixture B 120b | Forward Disabled | Forward Disabled | Forward Enabled | Forward Enabled | Forward Enabled | Forward Enabled |
| Light Fixture C | Forward Disabled | Forward Disabled | Forward Disabled | Forward Enabled | Forward Enabled | Forward Enabled |
| Light Fixture D | Forward Disabled | Forward Disabled | Forward Disabled | Forward Disabled | Forward Enabled | Forward Enabled |
| Light Fixture E | Forward Disabled | Forward Disabled | Forward Disabled | Forward Disabled | Forward Disabled | Forward Enabled |

In some examples, each processor 124*a*, 124*b* through 124*z* transmits address data (e.g., network address for the light fixture, serial number for the light fixture, serial numbers for the lights within the light fixture) for the respective light fixture A 120*a*, B 120*b* through Z 120*z* based on the enable forward control command. The address data can be dynamically generated (e.g., generated based on location of light fixture, generated based on light settings for light fixture), factory set (e.g., network address of the transceiver, serial number of the processor), and/or set by an installer of the light fixture. Table 2 illustrates the address data for the light fixtures. As illustrated in Table 2, the enable forward control command cascades through the plurality of light fixtures to sequentially access address data for the light fixture. In this example, the light fixtures are connected serially, Light Fixture A 120*a* to Light Fixture B 120*b* to Light Fixture C to Light Fixture D to Light Fixture E, and the sequential transmission of the enable forward control command enables the technology to advantageously automatically obtain address data for the slave devices in the serial chain which decreases the installation time and cost.

TABLE 2

| Status of Light Fixtures | | | | |
|---|---|---|---|---|
| | Commands from Light Array Controller 110 | | | |
| | Disable Forward Control Command | Enable Forward Control Command | Enable Forward Control Command | Enable Forward Control Command |
| Light Fixture A 120a | Forward Disabled | Forward Enabled and Address HLDS23423 | Forward Enabled | Forward Enabled |
| Light Fixture B 120b | Forward Disabled | Forward Disabled | Forward Enabled and Address ABDEA3242 | Forward Enabled |
| Light Fixture C | Forward Disabled | Forward Disabled | Forward Disabled | Forward Enabled and Address YUI23423 |

In other examples, each processor 124*a*, 124*b* through 124*z* forwards one or more additional enable forward control commands based on the enable forward control command. As illustrated in Tables 1 and 2, the light fixtures A 120*a*, B 120, C, D, and E forward any further enable forward control commands received after the initial enable forward control command. The forwarding of the enable forward control commands advantageously enables the technology to automatically and efficiently determine the addresses for light fixtures serially connected together thereby decreasing provisioning costs associated with the light fixtures.

In some examples, as illustrated in Table 3, the light array controller 110 receives address data for each of the plurality of light fixtures in response to the enable forward control command. In other examples, the light array controller 110 associates the received address data with each of the plurality of light fixtures. The address data and associations to the light fixtures advantageously enables the technology to quickly and accurately communicate with each individual light fixture without time-consuming and costly light fixture to light fixture provisioning.

TABLE 3

| Light Fixture Addresses | |
|---|---|
| | Address |
| Light Fixture A 120a | HLDS23423 |
| Light Fixture B 120b | ABDEA3242 |
| Light Fixture C | YUI23423 |

In some examples, the light array controller 110 transmits a light command to an individual light fixture in the plurality of light fixtures based on the address data associated with the individual light fixture (e.g., turn on to address KJL, change intensity to address TWE). In other examples, the disable forward control command and the enable forward command are in a remote device management (RDM) lighting protocol. The RDM lighting protocol is an enhancement to USITT DMX512. The RDM lighting protocol allows for bi-directional communication between a light array controller and RDM fixtures over a standard DMX line. It allows for configuration, status monitoring, and management of these fixtures in a manner that does not disturb the normal operation of standard DMX512 devices that do not recognize the RDM protocol. The standard is officially known as "ANSI E1.20." In some examples, the commands are in any other lighting protocol (e.g., power line communication (PLC)). In other examples, the one or more light fixtures include a plurality of light emitting diodes (LEDs). For example, each of the light fixtures includes ten LEDs.

Figure 2:
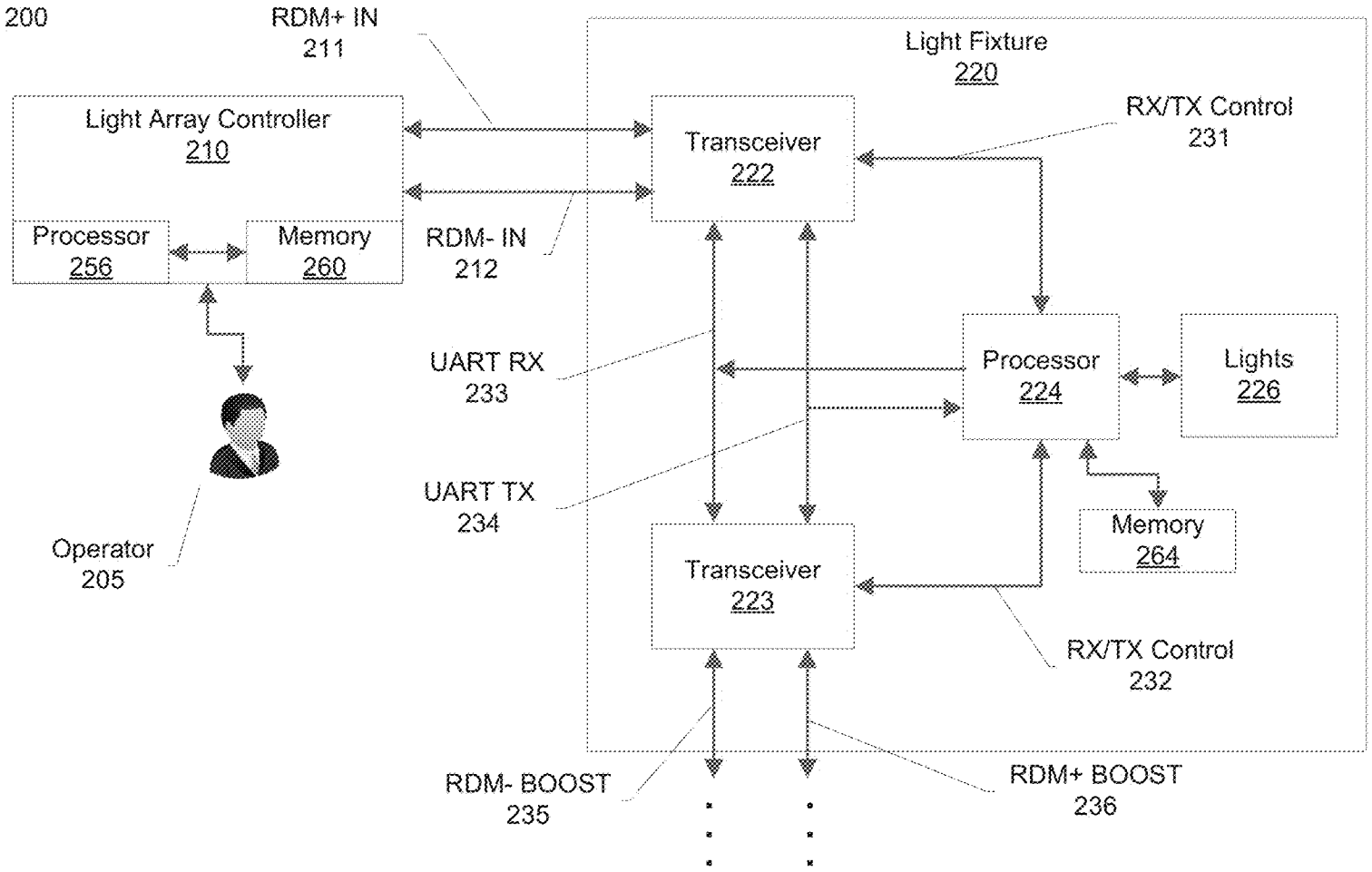
FIG. 2 is a block diagram of an exemplary lighting environment.

FIG. 2 is a block diagram of an exemplary lighting environment 200. The environment 200 includes a light array controller 210 and a light fixture 220. The light fixture 220 includes transceivers 222 and 223, a processor 224, memory 264, and lights 226. The light array controller 210 includes a processor 256 and memory 260. An operator 205 utilizes the light array controller 210 to control and/or provision (e.g., install, initial installation) the light fixture 220 and one or more slave light fixtures (not shown). In this example, the light fixture 220 is a master light fixture since the light fixture 220 is directly connected to the light array controller 210 via the RDM+ IN 211 and RDM− IN 212 lines. The light fixture 220, via the transceiver 222, and the light array controller 210 can communicate (e.g., communicate packets, communicate commands) via the RDM+ IN 211 and RDM− IN 212 lines (e.g., transmit commands, receive commands).

The processors 256 and 264 execute the operating system and/or any other computer executable instructions for the lighting environment 200 (e.g., executes applications). Memory in the system, modules or components can include code representing instructions that when executed cause one or more processors to perform the method steps described herein. The memory 264 and 260 store, for example, lighting protocol information and/or configuration information. Memory can include a plurality of storage devices and/or the environment 200 can include a plurality of storage devices (e.g., a protocol storage device, an instruction storage device). The memory can include, for example, long-term storage (e.g., a hard drive, a tape storage device, flash memory), short-term storage (e.g., a random access memory, a graphics memory), and/or any other type of computer readable storage.

The modules and devices described herein can, for example, utilize the processor 224 and/or processor 256 to execute computer executable instructions and/or the modules and devices described herein can, for example, include their own processor to execute computer executable instructions (e.g., a protocol processing unit, a field programmable gate array processing unit). It should be understood the environment 200 can include, for example, other modules, devices, and/or processors known in the art and/or varieties of the illustrated modules, devices, and/or processors. Embodiments can include single processors to perform various functions, or functions can be performed by one or more processors in some embodiments.

The light fixture 220, via the transceiver 223, can communicate with other light fixtures via the RDM− BOOST 235 and the RDM+ BOOST 236 lines. The transceiver 223 can boost (e.g., increase power, decrease interference) the command. The transceiver 223 communicates with the transceiver 222 via UART RX 233 and UART TX 234 lines. The processor 224 can control the transceiver 222 via the RX/TX control 231 line (e.g., instruct the transceiver 222 to stop receiving commands, instruct the transceiver 222 to forward all communication). The processor 224 can control the transceiver 223 via the RX/TX control 232 line (e.g., instruct the transceiver 223 to disable forwarding, instruct the transceiver 223 to power down). The processor 224 can receive communication via the UART TX 234 line and/or can insert communication via the UART RX 233 line.

The processor 224 can control the lights 226 utilizing commands received via the transceiver 222 (e.g., turn on lights 226, change the intensity of the lights 226). The processor 224 can control the transceiver 223 to turn on and turn off communication forwarding in response to commands received from the light array controller 210. The processor 224 can respond to a request from the light array controller 210 and transmit address data (e.g., serial number of the light fixture 220, serial number of the processor 224, network address of the transceiver 222) to the light array controller 210 via the transceiver 222.

Although FIG. 2 illustrates two transceivers 222 and 223, the light fixture 220 can include a single transceiver utilized to communicate with the light array controller 210 and other light fixtures. Although FIG. 2 illustrates two transceivers 222 and 223, the light fixture 220 can include separate receivers and transmitters. For example, the light fixture 220 can include a receiver to receive communication from the light array controller 210 and the receiver is coupled to a transmitter for transmission of the communication to other light fixtures, if forwarding is enabled.

Figure 3:
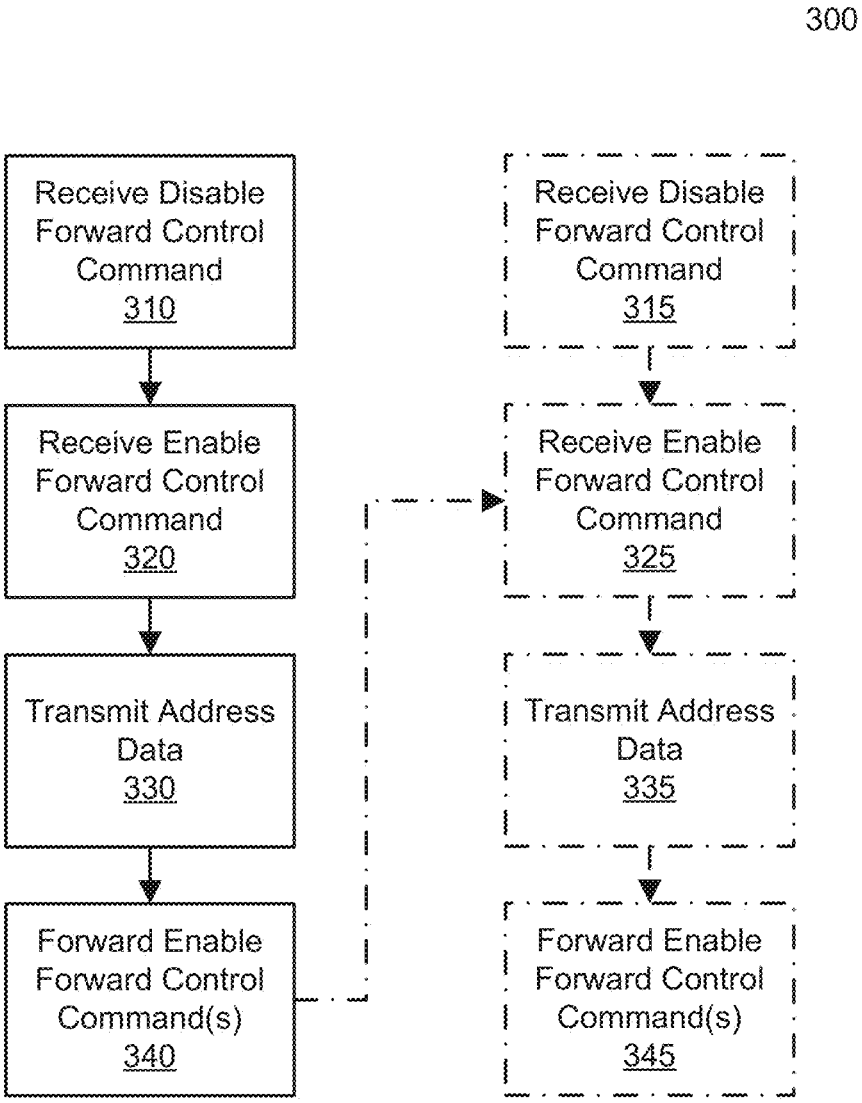
FIG. 3 is a process diagram of an exemplary automatic light fixture address method.

FIG. 3 is a flowchart illustrating an exemplary automatic light fixture address method 300 utilizing, for example, the light fixtures A 120*a*, B 120*b* through Z 120*z* of FIG. 1. The processor 124*a* in the light fixture A 120*a* receives (310) a disable forward control command to disable data forwarding through the light fixture A 120*a*. The processor 124*a* in the light fixture A 120*a* receives (320) an enable forward control command to enable data forwarding through the light fixture. The processor 124*a* in the light fixture A 120*a* transmits (330) address data for the light fixture based on the enable forward control command. The processor 124*a* in the light fixture A 120*a* forwards (340) one or more additional enable forward control commands based on the enable forward control command.

In some examples, the processor 124*b* in the light fixture B 120*b* receives (315) a second disable forward control command to disable data forwarding through the second light fixture. The processor 124*b* in the light fixture B 120*b* receives (325) a second enable forward control command to enable data forwarding through the second light fixture. As illustrated in FIG. 3, the enable forward control command can be forwarded (340) from the processor 124*a* in the light fixture A 120*a*. The processor 124*b* in the light fixture B 120*b* transmits (335) second address data for the second light fixture based on the second enable forward control command. The processor 124*b* in the light fixture B 120*b* forwards (345) one or more additional enable forward control commands based on the second enable forward control command.

In other examples, the light fixture A 120*a* and the light fixture B 120*b* are serially connected. In other words, commands for the light fixture B 120*b* are communicated to the light fixture A 120*a* and then forwarded to the light fixture B 120*b*.

In some examples, the disable forward control command and the enable forward command are in a remote device management (RDM) lighting protocol. In other examples, the disable forward control command and/or the enable forward command are encapsulated in any other type of lighting protocol (e.g., power line communication). In some examples, the disable forward control command and/or the enable forward command are in any other type of lighting protocol and then encapsulated in the RDM lighting protocol.

Figure 4:
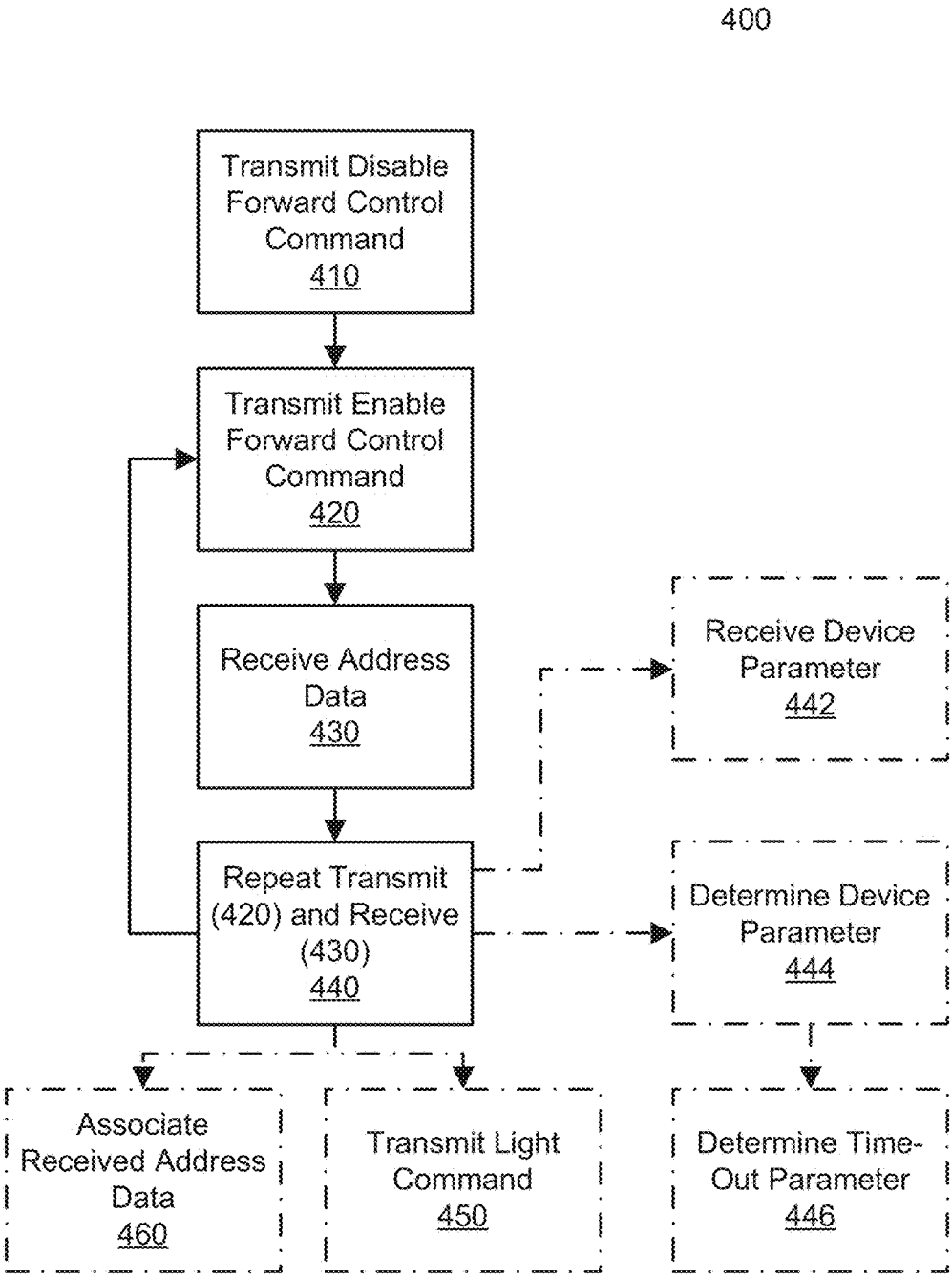
FIG. 4 is a flowchart of another exemplary automatic light fixture address method.

FIG. 4 is a flowchart illustrating an exemplary automatic light fixture address method 500 utilizing, for example, the light array controller 110 of FIG. 1. The light array controller 110 transmits (410) a disable forward control command to a master light fixture serially connected to a plurality of light fixtures. The light fixtures are serially connected to each other (e.g., chained together, communication occurs sequentially). The light array controller 110 transmits (420) an enable forward control command to the master light fixture. The light array controller 110 receives (430) address data for the master light fixture or one of the plurality of light fixtures. The light array controller 110 repeats (440) the transmitting step (420) and the receiving step (430) based on a device parameter.

In some examples, the light array controller 110 determines (444) the device parameter based on a time period from the transmitting step (420) and a time-out parameter. In other examples, the light array controller 110 determines (446) the time-out parameter based a number of the plurality of light fixtures (e.g., ten light fixtures times one second per light fixture for a time-out parameter of ten seconds, twenty light fixtures times four seconds per light fixture for a time-out parameter of eighty seconds).

In some examples, the light array controller 110 receives (442) the device parameter from an operator associated with the light array controller. The device parameter can be a number of the plurality of light fixtures (e.g., twenty light fixtures, forty light fixtures).

In other examples, the light array controller 110 transmits (450) a light command to a light fixture in the plurality of light fixtures based on the received address data for the light fixture. In some examples, the light array controller 110 associates (460) the received address data from the plurality of light fixtures with individual light fixtures within the plurality of light fixtures.

Comprise, include, and/or plural forms of each are open ended and include the listed parts and can include additional parts that are not listed. And/or is open ended and includes one or more of the listed parts and combinations of the listed parts.

One skilled in the art will realize the invention may be embodied in other specific forms without departing from the spirit or essential characteristics thereof. The foregoing embodiments are therefore to be considered in all respects illustrative rather than limiting of the invention described herein. Scope of the invention is thus indicated by the appended claims, rather than by the foregoing description, and all changes that come within the meaning and range of equivalency of the claims are therefore intended to be embraced therein.

What is claimed is:

1. A light controller system, comprising:

a plurality of light fixtures in serial communication with each other, each light fixture of the plurality of light fixtures comprising:

a transmitter, and a processor configured to instruct the transmitter to disable transmission of control commands based on a disable forward control command and enable transmission of control commands based on an enable forward control command, wherein the serial communication among the plurality of light fixtures is in a remote device management (RDM) lighting communication protocol; and a light array controller configured to transmit the disable forward control command and the enable forward control command; wherein each light fixture of the plurality of light fixtures is individually discoverable and addressable via the serial communication based on commands received from the light array controller.

2. The light controller system of claim 1, wherein each processor is further configured to transmit address data for the respective light fixture based on the enable forward control command.

3. The light controller system of claim 1, wherein each processor is further configured to forward one or more additional enable forward control commands based on the enable forward control command.

4. The light controller system of claim 1, wherein the light array controller is further configured to receive address data for each of the plurality of light fixtures in response to the enable forward control command.

5. The light controller system of claim 4, wherein the light array controller is further configured to associate the received address data with each of the plurality of light fixtures.

6. The light controller system of claim 5, wherein the light array controller is further configured to transmit a light command to an individual light fixture in the plurality of light fixtures based on the address data associated with the individual light fixture.

7. The light controller system of claim 1, wherein the one or more light fixtures comprise a plurality of light emitting diodes (LEDs).

8. An automatic light fixture address method, comprising:

(a) receiving, via a processor in a light fixture, a disable forward control command to disable data forwarding through the light fixture;

(b) receiving, via the processor in the light fixture, an enable forward control command to enable data forwarding through the light fixture;

(c) transmitting, via the processor and a transmitter in the light fixture, address data for the light fixture based on the enable forward control command; and (d) forwarding, via the processor and the transmitter in the light fixture, one or more additional enable forward control commands based on the enable forward control command, wherein:

the light fixture is one of a plurality of light fixtures in serial communication with each other;

each light fixture of the plurality of light fixtures is individually discoverable and addressable via the serial communication based on commands received from a light array controller; and steps (a), (b), (c) and (d) comprise the serial communication carried out among the plurality of light fixtures in a remote device management lighting communication protocol.

9. The method of claim 8, further comprising:

(a-1) receiving, via a second processor in a second light fixture, a second disable forward control command to disable data forwarding through the second light fixture;

(b-1) receiving, via the second processor in the second light fixture, a second enable forward control command to enable data forwarding through the second light fixture;

(c-1) transmitting, via the second processor in the second light fixture, second address data for the second light fixture based on the second enable forward control command; and (d-1) forwarding, via the second processor in the second light fixture, one or more additional enable forward control commands based on the second enable forward control command, wherein the light fixture and the second light fixture are serially connected, and steps (a-1), (b-1), (c-1) and (d-1) are carried out in the remote device management (RDM) lighting communication protocol.

10. An automatic light fixture address method, comprising:

(a) transmitting, via a processor in a light array controller, a disable forward control command to a master light fixture serially connected to a plurality of light fixtures, the plurality of light fixtures being serially connected to each other and being adapted to communicate via a transceiver in each light fixture of the plurality of light fixtures;

(b) transmitting, via the processor in the light array controller, an enable forward control command to the master light fixture;

(c) receiving, via the processor in the light array controller, address data for the master light fixture or one of the plurality of light fixtures;

(d) repeating the transmitting step (b) and the receiving step (c) based on a device parameter, wherein:

each light fixture of the plurality of light fixtures is individually discoverable and addressable via the serial communication based on commands received from the light array controller; and steps (a), (b), (c) and (d) are carried out in a remote device management lighting communication protocol.

11. The method of claim 10, wherein the repeating step (d) further comprising (d-1) determining the device parameter based on a time period from the transmitting step (b) and a time-out parameter.

12. The method of claim 11, wherein the repeating step (d) further comprising (d-2) determining the time-out parameter based a number of the plurality of light fixtures.

13. The method of claim 10, further comprising (a-1) receiving the device parameter from an operator associated with the light array controller, the device parameter is a number of the plurality of light fixtures.

14. The method of claim 10, further comprising (e) transmitting a light command to a light fixture in the plurality of light fixtures based on the received address data for the light fixture.

15. The method of claim 10, further comprising (e) associating the received address data from the plurality of light fixtures with individual light fixtures within the plurality of light fixtures.

16. A light array controller, comprising:

one or more processors: and memory, the memory including code representing instructions that when executed cause the one or more processors to:

(a) transmit a disable forward control command to a master light fixture serially connected to a plurality of light fixtures, the plurality of light fixtures being serially connected to each other and being adapted to communicate with each other via a transceiver in each light fixture of the plurality of light fixtures, and (b) transmit an enable forward control command to the master light fixture, wherein:

each light fixture of the plurality of light fixtures is individually discoverable and addressable via the serial communication based on commands received from the light array controller; and steps (a) and (b) are carried out in a remote device management lighting communication protocol.

17. The controller of claim 16, wherein the memory includes code representing instructions that when executed cause the one or more processors to:

(c) receive address data for the master light fixture or one of the plurality of light fixtures, wherein step (c) is carried out in the remote device management (RDM) lighting communication protocol.

18. The controller of claim 17, wherein the memory includes code representing instructions that when executed cause the one or more processors to:

(d) repeat the transmitting step (b) and the receiving step (c) based on a device parameter.

19. The controller of claim 18, wherein the memory includes code representing instructions that when executed cause the one or more processors to repeat step (d) and further including (d-1) determining the device parameter based on a time period from the transmitting step (b) and a time-out parameter.

20. The controller of claim 19, wherein the memory includes code representing instructions that when executed cause the one or more processors to repeat step (d) and further including (d-2) determining the time-out parameter based a number of the plurality of light fixtures.

21. The controller of claim 18, wherein the memory includes code representing instructions that when executed cause the one or more processors to (a-1) receive the device parameter from an operator associated with the light array controller, the device parameter is a number of the plurality of light fixtures.

22. The controller of claim 18, wherein the memory includes code representing instructions that when executed cause the one or more processors to (e) transmit a light command to a light fixture in the plurality of light fixtures based on the received address data for the light fixture.

23. The controller of claim 18, wherein the memory includes code representing instructions that when executed cause the one or more processors to (e) associate the received address data from the plurality of light fixtures with individual light fixtures within the plurality of light fixtures.

* * * * *